United States Patent [19]

Barber

[11] Patent Number: 4,955,311

[45] Date of Patent: Sep. 11, 1990

[54] FOLDAWAY FLOATING DOCK

[76] Inventor: William B. Barber, 9613 Woodlawn Dr., Portage, Mich. 49002

[21] Appl. No.: 273,195

[22] Filed: Nov. 18, 1988

[51] Int. Cl.[5] ..... B63C 1/00

[52] U.S. Cl. ..... 114/263; 405/219

[58] Field of Search ..... 114/263, 266, 267; 14/2.6, 75; 405/218–220

[56] References Cited

U.S. PATENT DOCUMENTS

| | | | |
|---|---|---|---|
| 1,041,147 | 10/1912 | Murphy | 287/99 |
| 1,772,096 | 8/1930 | Diamond | 287/99 |
| 2,694,587 | 11/1954 | Bullough | 287/99 |
| 2,965,339 | 12/1960 | Rizzuto | 287/99 |
| 3,009,326 | 11/1961 | Williams | 61/48 |
| 3,043,109 | 7/1962 | Erickson | 405/220 |
| 3,050,947 | 8/1962 | Burton | 405/219 |
| 3,397,546 | 8/1968 | Eisert et al. | 405/220 |
| 3,680,448 | 8/1972 | Ballingall et al. | 94/1.5 |
| 4,386,441 | 6/1983 | Lundholm | 14/2.6 |
| 4,645,380 | 2/1987 | Hambrick et al. | 114/263 |
| 4,695,195 | 9/1987 | Brande | 405/220 |

*Primary Examiner*—Joseph F. Peters, Jr.
*Assistant Examiner*—Edwin L. Swinehart
*Attorney, Agent, or Firm*—Flynn, Thiel, Boutell & Tanis

[57] ABSTRACT

A foldaway floating dock for use on a body of water includes a plurality of floatable dock sections and a frame for interconnecting the dock sections. The frame includes an arrangement for slidably supporting each of the dock sections for movement away from and toward an adjacent dock section. The frame further includes an arrangement for facilitating pivotal movement of each dock section through 90° relative to an adjacent dock station. The arrangement for facilitating pivotal movement is operable only when a dock section is spaced from an adjacent dock section, thereby allowing a folding of the dock sections one upon the other.

15 Claims, 5 Drawing Sheets

FOLDAWAY FLOATING DOCK

FIELD OF THE INVENTION

This invention relates to an improved floating dock for use on a body of water and, more particularly, to an improved floating dock which can be quickly and easily folded for retraction from the water, and unfolded for extension onto the water.

BACKGROUND OF THE INVENTION

Docks which are retractable from a body of water are desirable for a number of important reasons. For instance, and particularly on large bodies of water, bad storms can cause heavy waves which may damage a dock that is left extended on the body of water. The frequency of such storms in some areas and the often unavoidable insufficiency of advance warning of such storms make a dock which can be quickly and easily retrieved desirable. In areas where the water freezes in winter, docks must be removed from the water to avoid damage to the dock due to the freezing water. Even in areas where the water does not freeze over in the winter, it is often necessary to remove docks from the water because of substantially higher water levels in the winter. As fall begins to give way to winter, the dock owner must arrange to remove the dock from the water. By this time of the year, however, water temperatures are obviously quite cool. Therefore, those dock owners who must get into the water to retrieve their dock often do so in late summer or very early fall, to avoid working in the cold water. But water activities such as fishing and boating, which are facilitated by a dock, can be pursued well past the time when the water temperature has dropped to an uncomfortably or even dangerously cold level. Therefore, a dock which can be retracted from the water without getting into the water is desirable.

Many people who maintain summer cottages or seasonal homes on large bodies of water occupy the premises only on weekends, holidays, and vacations. Therefore, to prevent unauthorized use of an unattended dock, and to avoid the potential liability associated therewith, it is often advisable to retract the dock from the water for storage during those periods of the recreational season when the premises are left unoccupied. Since weekend and holiday trips to the body of water are often numerous during the recreational season, the dock must be retracted and extended many times. Thus, a quickly and easily retractable and extendible dock is potentially very valuable to the summer cottage or seasonal home owner.

Activities such as fishing and swimming often can be more fully enjoyed, for example, from the middle of a lake rather than the shoreline. Obviously, boats are often used as a base from which to fish and swim at locations distant from the shore. However, a floating dock can be employed just as easily at such a location by using a common boat anchor and line to anchor the dock to the bottom of the body of water, or the floating dock can even be secured to the shoreline by a rope, for instance. Such floating docks are commonly employed at recreational areas to support life guard towers and as safe resting areas for tired swimmers.

Accordingly, it is an object of the present invention to provide a foldaway floating dock which is easily foldable for storage.

It is a further object of the present invention to provide a floating dock, as aforesaid, which, when anchored to the shoreline, can be quickly and easily retracted from the body of water.

It is a further object of the invention to provide a floating dock, as aforesaid, which requires no tools or power equipment to fold and retract the dock.

It is a further object of the invention to provide a floating dock, as aforesaid, which can be retracted and folded without getting into the water.

It is a further object of the invention to provide a floating dock, as aforesaid, which can be quickly and easily extended back onto the water with no tools or power equipment required and without getting into the water.

It is a further object of the invention to provide a floating dock, as aforesaid, which is of simple and durable construction and is easily maintainable.

SUMMARY OF THE INVENTION

The objects and purposes of the invention, including those set forth above, are met by providing a plurality of floatable dock sections and a frame for interconnecting the dock sections. An arrangement is provided for supporting each of the dock sections for movement toward and away from each other. A further arrangement is provided for facilitating pivotal movement of each dock section relative to an adjacent dock section, the arrangement being operable only when the dock section to be pivotally moved is in a position spaced from the adjacent dock section relative to which the pivotal movement is to be made. The pivotal movement of the dock sections is used to effect a folding of adjacent dock sections, one upon the other.

BRIEF DESCRIPTION OF THE DRAWINGS

An exemplary embodiment will be described in detail hereinafter in connection with the drawings, in which.

DETAILED DESCRIPTION

Figure 1:
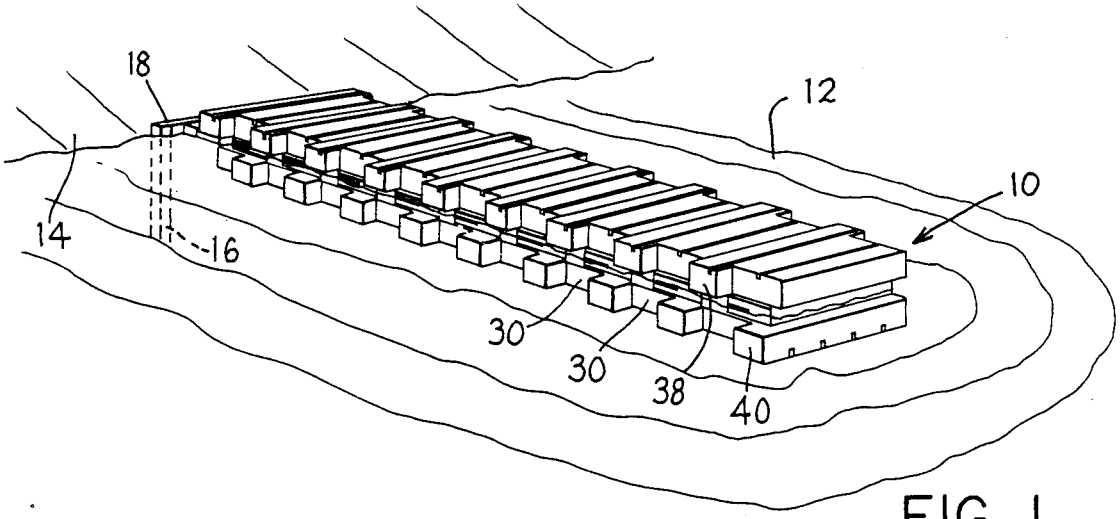
FIG. 1 is an oblique view of the inventive foldaway floating dock floating on the water in a position extended from the shoreline.
Figure 2:
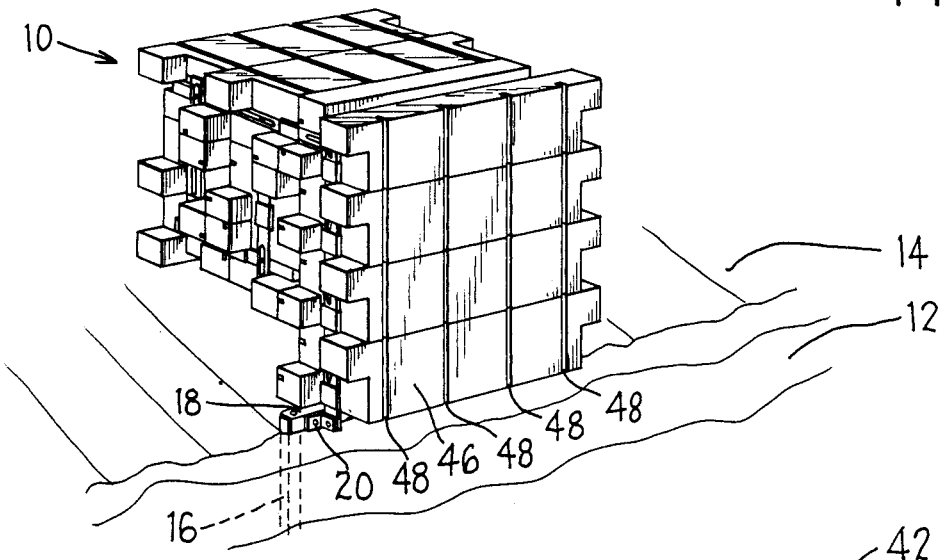
FIG. 2 is an oblique view of the inventive foldaway floating dock in a final folded position on the shoreline and retracted from the water.

Referring to FIGS. 1 and 2, the inventive foldaway floating dock assemblage 10 is shown, respectively, in its fully extended position floating on the surface of a body of water 12, and in its fully retracted position folded on the shoreline 14. As shown in FIG. 1, the dock 10 is, in effect, a floating walkway extending from the shoreline 14 outwardly across the body of water 12 and floating on the surface thereof. The dock 10 may be of any desired length, and can thus extend outwardly over the surface of the body of water 12 to any desired distance.

Figure 8:
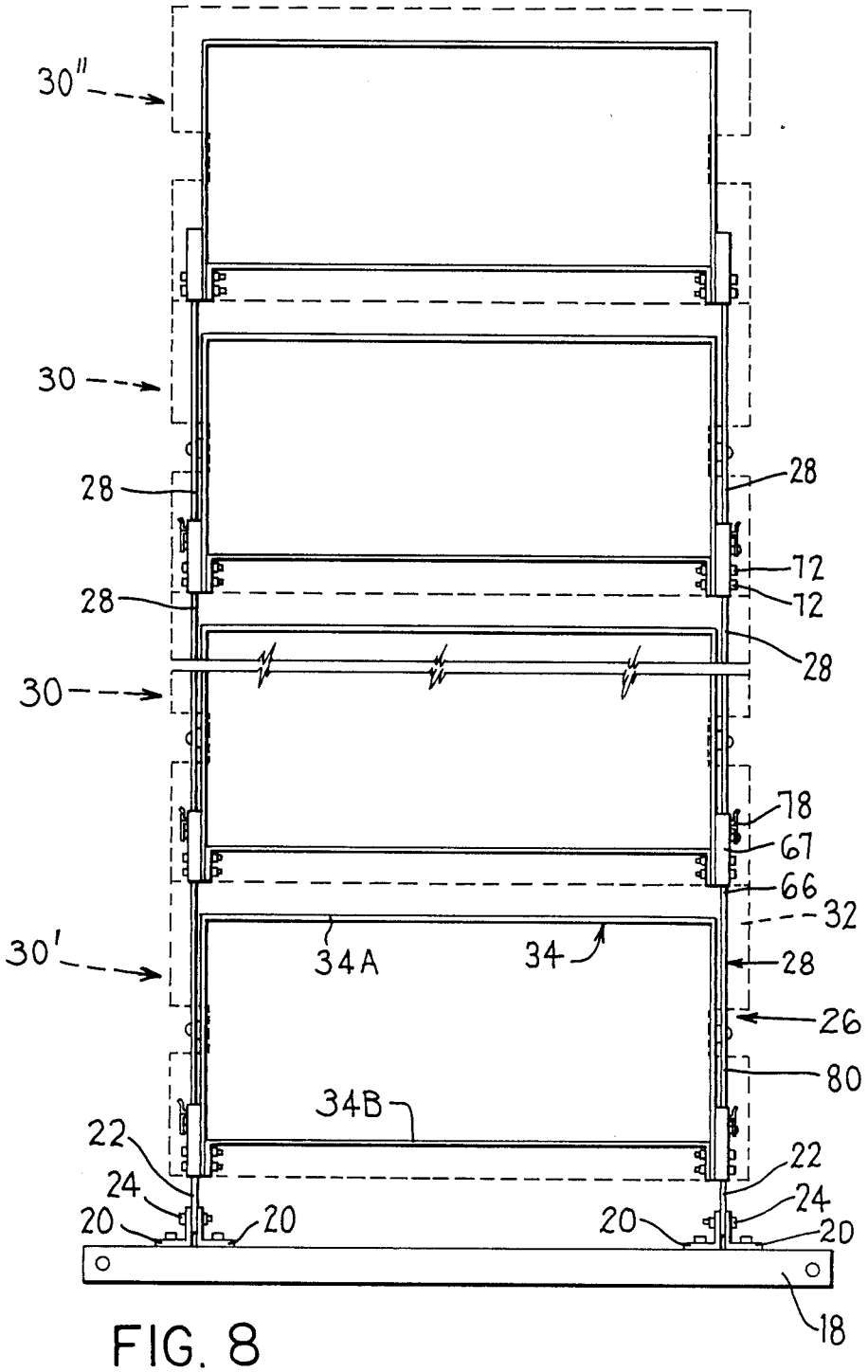
FIG. 8 is a top view of the inventive dock with the buoyant blocks removed.

Referring to FIGS. 1, 2 and 8, a pair of laterally spaced anchor posts 16 (only one of which is shown) are disposed in the ground beneath the surface of the water 12 adjacent the shoreline 14. The anchor posts 16 both extend upwardly above the surface of the water 12 and are there connected to the ends of an elongate and horizontally extending anchor arm 18. The anchor arm 18 extends generally parallel to the shoreline 14. Two pairs of back-to-back L-shaped brackets 20 are bolted to the side of the anchor arm 18 facing the shoreline 14, as shown in FIG. 8. The leg of each mutually adjacent L extending away from the anchor arm 18 are oriented so as to be slightly spaced and receiving a pivotally supported mounting arm 22 therebetween. The pivotal support for each arm 22 is provided by a bolt 24 secured to and extending between the legs and through a hole in the arm. The pivotal mounting arms 22 pivotally connect a frame structure 26 (to be described in more detail below) of the dock 10 to the anchor arm 18. The mounting arms 22 are spaced from each other by an amount equal to the width of the frame structure 26. The frame structure 26 comprises a plurality of link arms 28 which interconnect a plurality of floatable dock sections 30, 30' and 30'' to form the floating dock assemblage 10.

Figure 5:
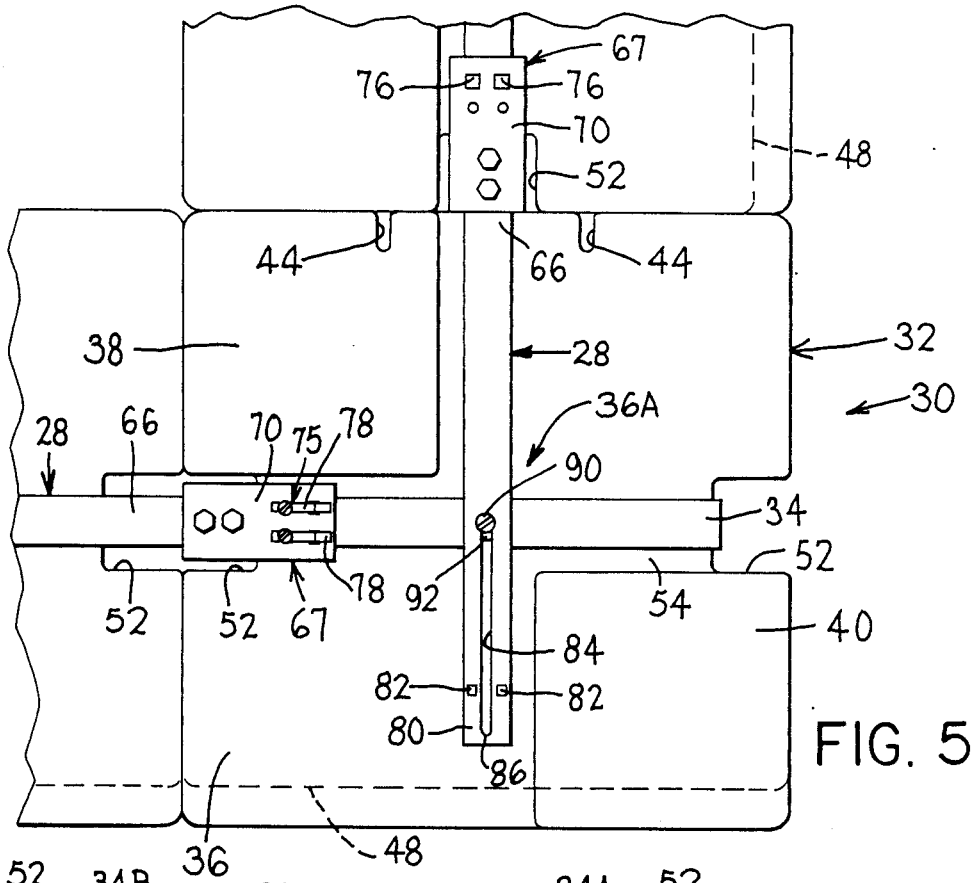
FIG. 5 is a fragmentary elevational side view generally similar to FIG. 4 but showing the inventive dock in a position wherein one dock section is folded upon an adjacent section.
Figure 6:
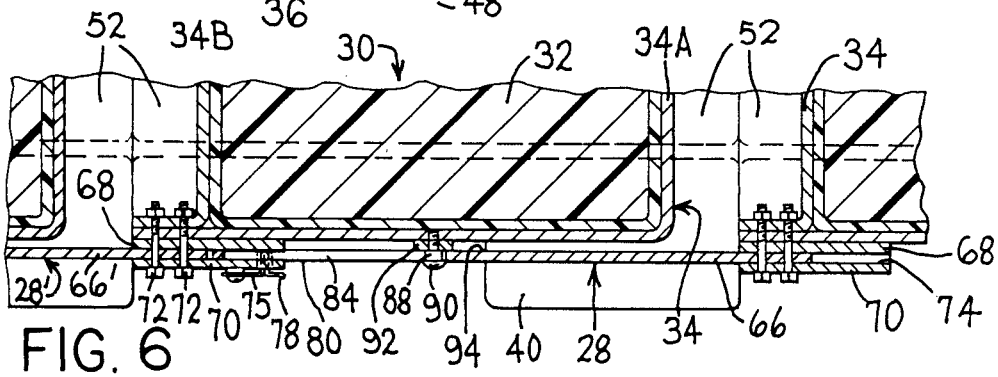
FIG. 6 is a fragmentary sectional view taken along the line VI—VI of FIG. 3.
Figure 7:
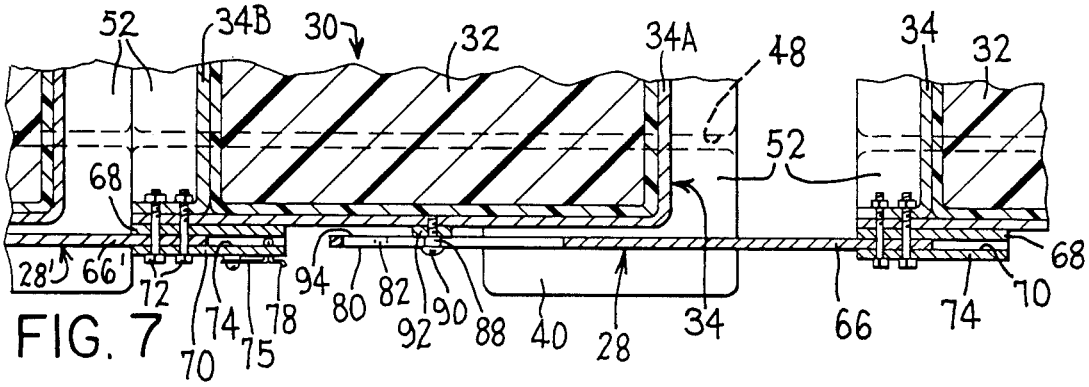
FIG. 7 is a fragmentary sectional view taken along the line VII—VII of FIG. 4.

Referring to FIGS. 5–7, each floatable dock section 30, 30' and 30'' includes a buoyant block 32 adapted to float directly in the water 12 and a frame unit 34 which surrounds or encircles the outer periphery of the buoyant block 32. Each buoyant block 32 is constructed from a buoyant foamed plastic material, for example, a closed cell polyurethane encased in a high-strength plastic shell made of PVC (polyvinylchloride). Each block 32 constructed in this manner is capable of floating on the surface of the water 12 and thereby supporting an average-size person above the water, so that a plurality of the blocks 32 connected together are capable of floating on the surface of the water while supporting a considerable number of persons or amount of weight above the water. As shown in FIGS. 1 and 8, the buoyant blocks 32 are all of substantially uniform size and shape.

Figure 9:
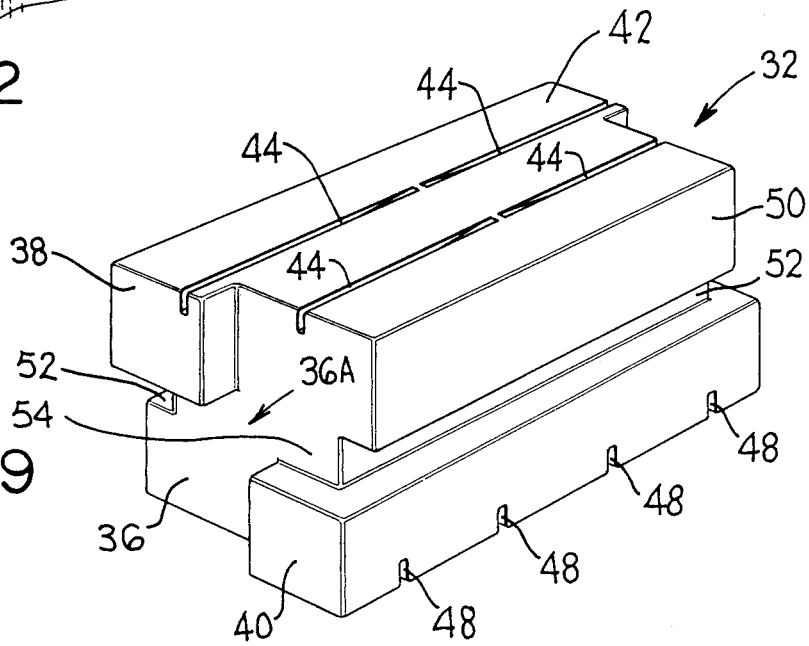
FIG. 9 is an oblique view of a single buoyant block from which the inventive floating dock is constructed.
Figure 3:
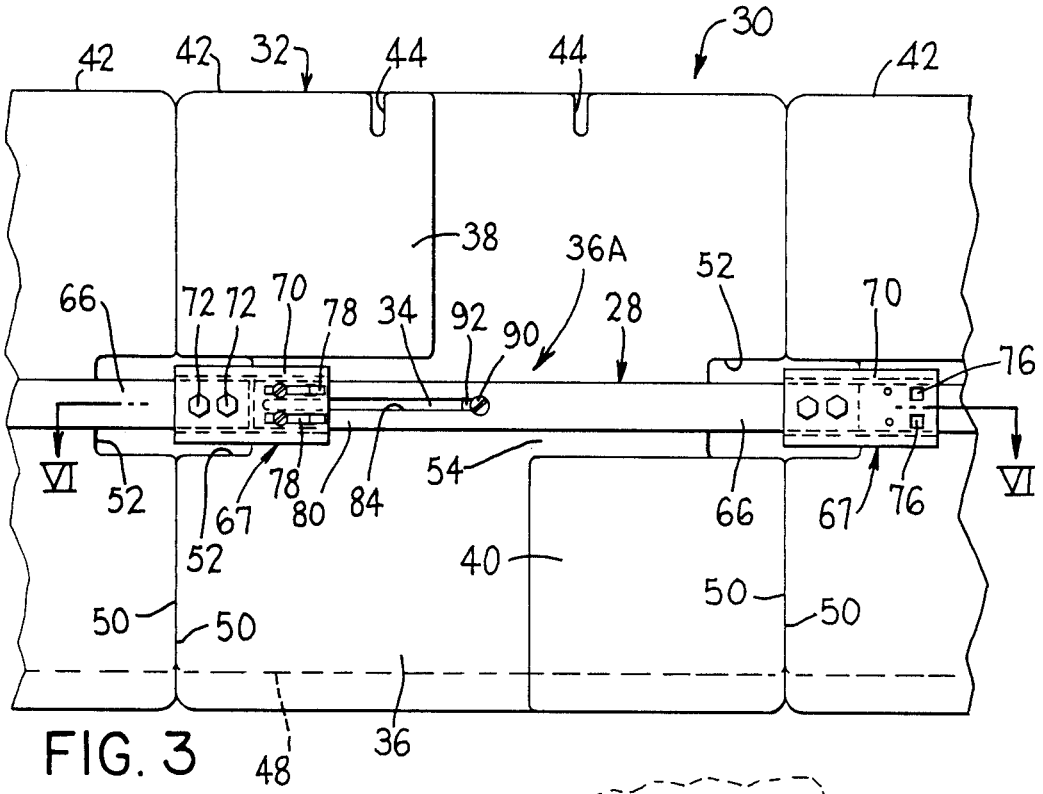
FIG. 3 is a fragmentary elevational side view of the inventive fold floating dock.
Figure 4:
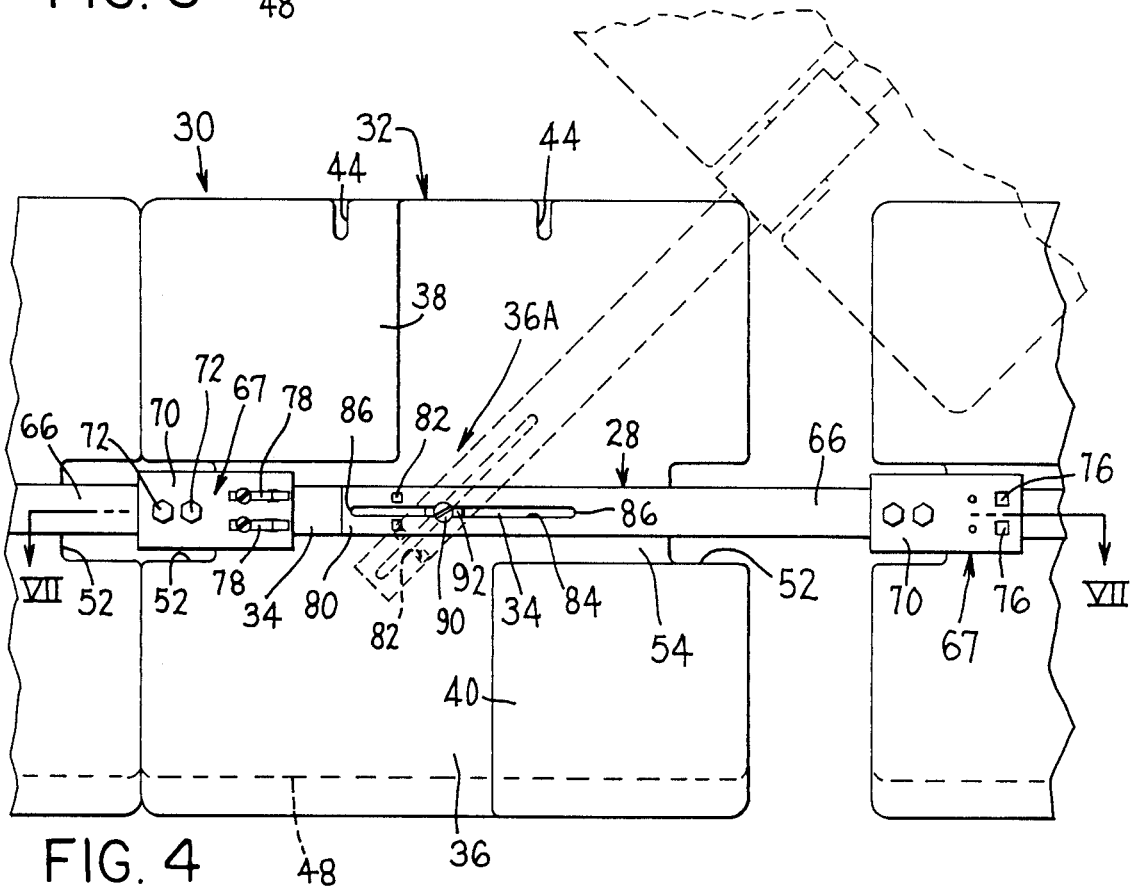
FIG. 4 fragmentary elevational side view generally similar to FIG. 3 but showing the foldaway floating dock in different positions of operation.

As shown in FIG. 9, each buoyant block 32 is basically a rectangular block which has a cross-section, taken in a direction perpendicular to its elongate direction, that is generally square (see FIGS. 3–5). Each buoyant block 32 has two end surfaces 36, only one of which is shown. However, the opposite end surface 36 is a mirror image of the end surface 36 which is shown, and therefore a description of the end surface 36 should be sufficient. As noted previously, the buoyant block 32 has a generally square cross-section, and thus the end surface 36 has this generally square shape. Two diagonally spaced bumper portions 38 and 40 project perpendicularly from the end surface 36. Both bumper portions 38 and 40 have a generally square cross-section. The bumper projections 38 and 40 are located adjacent opposite diagonally spaced corners of the square end surface 36. The bumper portions 38 and 40 are spaced such that a central part of the end surface 36 defines a gap 36A therebetween. As shown in FIG. 1, when the dock 10 is in its extended floating position, the bumper portion 38 is spaced from the water 12, the bumper portion 40 is on or in the water 12, and the bumper portion 38 is closer to the shoreline 14 than is the bumper portion 40.

Each buoyant block 32 has a walking surface 42 extending perpendicularly between the end surfaces 36, on which dock users walk, stand, etc. The walking surface 42 has formed therein four narrow elongate channels 44. Each channel 44 extends from a location near the center of the walking surface 42 to a respective end surface 36 of the buoyant block 32. The channels 44 are formed in pairs aligned in the elongate direction. The channels 44 of each pair extend to respective opposite end surfaces 36 of the buoyant block 32. Each channel 44 extends deeper into the buoyant block 32 as it proceeds toward the end surfaces 36, in order to carry off excess water from the walking surface 42.

As shown in FIG. 2, a base surface 46 extends opposite the walking surface 42 between the ends of each buoyant block 32. The base surface 46, as shown in FIG. 1, contacts the water 12 when the dock 10 is in its extended unfolded position. Referring again to FIG. 2, the base surface 46 has four narrow transverse channels 48 formed therein. The channels 48 extend entirely across the base surface 46 in a direction transverse to the elongate direction of the buoyant block 32, and parallel to each other. The channels 48 are spaced equally across the length of the base surface 46. Two side surfaces 50 (only one of which is shown) connect the end surfaces 36 and the walking surface 42 and base surface 46. The side surfaces 50 each have formed therein an elongate groove 52 which extends the entire length of the side surface 50. The elongate groove 52 is located equidistantly between the walking surface 42 and the base surface 46 in the side surface 50. The distance from the walking surface 42 and base surface 46 to the elongate groove 52 defines the dimension of the square formed by the cross-section of each of the projecting portions 38 and 40.

As shown in FIGS. 3–8, a frame unit 34 encircles the central portion 54 of each buoyant block 32 to form a dock section 30 (also 30' and 30''). Each frame unit 34 is composed of two parts 34A and 34B, 34A being a U-shaped part and 34B being a generally straight part which is attached to the U-shaped part 34A to form a rectangular frame unit which completely surrounds the central portion 54 of the buoyant block 32. The frame unit 34 is, in this embodiment, constructed from a thin, flat band-like material, so as to be easily wholly received in the elongate grooves 52 of the buoyant block 32. It is contemplated that the frame units 34 may be constructed from any suitable material, such as metal, as long as they are thin enough to be wholly received in the grooves 52. The parts 34A and 34B of the frame unit 34 have appropriately aligned holes therethrough so as to facilitate the reception of fastening bolts 72 therein to fasten them together, so that the frame unit 34 snugly abuts the buoyant block 32 while received in the grooves 52.

Turning now to the specifics of attachment of the frame units 34 of adjacent dock sections 30, 30' and 30'', and referring to FIGS. 3–7, the frame unit 34 of each dock section 30 has connected thereto at each lateral end a link arm 28. The link arms 28 are each an elongate and thin bar-like structure, preferably made of a durable metal. The link arms 28 at each end of the dock section 30 are constructed and operate as mirror images of each other. It should therefore be evident that the following discussion of the structure and the operation of a link arm 28 at an end of a frame unit 34 is applicable to all link arms 28 on all remaining frame units 34 of all dock sections 30, 30′ and 30″ in the dock assemblage 10.

The link arms 28 extend parallel to and alongside the ends of the dock section 30, transversely to the elongate dimension of the dock section 30. One end 66 of each link arm 28 is fixedly disposed within a collar 67 mounted on the frame unit 34, which collar has two parallel plates 68 and 70. The plates 68 and 70 extend parallel to the link arm 28, and the link arm 28 is snugly sandwiched therebetween. The collar 67 and the fixed end 66 are bolted to the frame unit 34 by the same bolts 72 which attach the parts 34A and 34B of the frame unit 34 to hold the frame unit in snug abutment with the central portion 54 of the buoyant block 32. The collar 67 extends beyond the fixed end 66 of the link arm 28 to define a gap 74 between the plates 68 and 70 within the collar 67. The parallel plate 70 has two vertically spaced holes 76 formed therethrough. A pair of vertically spaced elastic bands 75 each with a tab 78 thereon is attached to the plate 70 so that the tabs 78 are received in the holes 76 and are removably disposed in the gap 74 by a flexing of the elastic bands 75.

Each link arm 28 has a free end 80 which has formed therethrough two vertically spaced holes 82, adapted to be aligned with the vertically spaced holes 76, and an elongated slot 84 which has rounded ends and which extends from a location adjacent the free end 80 toward the fixed end 66 passing between the vertically spaced holes 82 and being approximately one-third of the total length of the link arm 28. The free end 80 of the link arm 28 is pivotally connected to the next adjacent frame unit 34 by means of a hinge pin 88 inserted transversely through the elongate slot 84 and attached to a lateral end of the frame unit 34, near the middle thereof. The hinge pin 88 has an enlarged head 90 at its free end which is too large to pass transversely through the elongate slot 84, thus preventing the free end 80 from moving laterally away from the end of the frame unit 34. A spacer ring 92 is disposed in encircling relationship around the hinge pin 88 between the free end 80 and the frame unit 34 and coacts with the plate 68 to maintain a spacing 94 between the link arm 28 and the frame unit 34. The slot 84 facilitates a sliding of the pin 88 therein to allow the dock sections 30, 30′ and 30″ to be capable of selected guided movement toward and away from each other, as will be explained in more detail below.

Referring to FIGS. 6 and 8, the frame unit 34 of a first dock section 30′, that is, the one closest to the shoreline 14, is connected to the anchor arm 18 by means of the pivotal mounting arms 22. The free ends of the mounting arms 22 are received in the gap 74 of the collar 67 and secured therein by the same bolts 72 which serve to connect the frame parts 34A and 34B together. The frame unit 34 of the first dock section 30′ is also fastened at its lateral ends or sides to two link arms 28 of an adjacent dock section 30 spaced further from the shoreline. The frame unit 34 of the adjacent dock section 30 is connected to the frame unit 34 of the next adjacent dock section 30 by two link arms 28 fixedly connected to the next dock section out from the shoreline and so on. All dock sections 30, 30′ and 30″ within the dock assemblage 10, except the first dock section 30′ which is anchored to the anchor arm 18, and the final dock section 30″ which forms the end of the dock remote from the anchor arm 18, have the respective lateral ends of their frame units 34 connected to the ends of the frame units 34 of each adjacent dock section 30 by two link arms 28, one at each end. There are thus four link arms 28 (or two link arms 28 and two mounting arms 22 as is the case for the dock section closest to shore) connected to each dock section 30, two at each end (except for the dock section 30″ furthest from the shore).

As shown in FIGS. 1 and 3, in this embodiment, the dock 10 is assembled such that the dock sections 30 are lined up in a single file row with side surfaces 50 abutting each other, such that the elongate direction of the buoyant blocks 32 is generally parallel to the shoreline 14, and the projecting bumper portions 38 and 40 project sidewardly.

The link arms 28 serve to connect the frame units 34 of the dock sections 30, 30′ and 30″ together to form the frame structure 26. Each link arm 28 is connected at its fixed end 66 to one of a pair of mutually adjacent frame units 34, and at its free end 80 to the other frame unit 34 of the pair. Thus, and as shown in FIGS. 3–7, each frame unit 34 has two link arms 28 attached to each end thereof. One link arm 28 is fixedly attached at its fixed end 66, and the other arm is slidably and pivotally attached at its free end 80. In other words, each link arm 28 is thus slidably and pivotally attached, as well as being adapted to be fixedly attached, to a first frame unit 34 and fixedly attached to a second frame unit 34 which is adjacent the first frame unit.

OPERATION

FIGS. 3–7 show the inventive foldaway floating dock in four positions of operation. The first position, depicted in FIGS. 3 and 6, is the locked position, which locked position is the normal position for use of the dock on a body of water as shown in FIG. 1. As shown in FIG. 3, the side surfaces 50 of the buoyant blocks 32 of the dock sections 30 abut each other in the locked position to provide a continuous dock surface composed of multiple adjacent walking surfaces 42. The link arm 28 extends alongside the central portion 54 of the buoyant block 32, between the projecting portions 38 and 40, through the gap 36A. Referring also to FIG. 4, the locked position is caused by the vertically spaced holes 82 in the free end 80 of the pivotal link arm 28 being aligned coaxially with the vertically spaced holes 76 in the parallel plate 70 of the collar 67 and by the resilient tabs 78 being inserted through the holes 76 into the gap 74 and through the aligned holes 82 in the free end 80 of the link arm 28. The resiliency of the elastic bands 75 serves to hold the tabs 78 in their inserted position in the holes 82, thus locking the free end 80 of the link arm 28 in a fixed position. In the locked position, the free end 80 of the link arm 28 abuts, or comes close to abutting, the fixed end 66′ (FIGS. 6 and 7) of an adjacent link arm 28′ within the collar 67. Since the fixed end 66 of the link arm 28 is attached fixedly to the frame unit 34 and fixedly attached to another frame unit 34 as at 78, the mutually adjacent dock sections 30 are fixedly held together in close abutting relation as shown in FIG. 3.

The second position of operation is an unlocked, spaced position illustrated in FIGS. 4 and 7. That is, the resilient tabs 78 are withdrawn from the aligned holes 76 and 82, the free end 80 of the link arm 28 is slid out of the gap 74, supported by the hinge pin 88 which is disposed in the elongate slot 84 to facilitate slidable movement. Thus, a dock section 30 may be moved away from an adjacent dock section 30 to a spaced position as shown in FIGS. 4 and 7. It is envisioned that the outermost dock section 30'' will be the first such section to become spaced from the next inwardly located dock section, i.e., the next one closer to the shoreline 14.

The third position of operation of the inventive foldaway floating dock is illustrated in dashed lines in FIG. 4 illustrating an intermediate position of the pivotal movement. From the extended or spaced position, the dock section 30 may be pivoted through 90° about the axis of the hinge pin 88 of the adjacent dock section 30 by means of the elongate slot 84 in the free end 80 of the pivotal link arm 28. During the pivotal movement, the dock section 30 is supported by the coaction of the hinge pin 88 and the elongate slot 84 of the free end 80 both for pivotal movement about and for movement toward and away from the adjacent dock section 30.

A fourth position of operation is shown in FIG. 5 illustrating the completely pivoted position. After the pivotal movement described above, the dock section 30 is supported for movement toward the adjacent dock section 30 by the co-action of the hinge pin 88 and elongate slot 84 of the free end 80. The dock section 30 is thus stacked upon the adjacent dock section 30 which it previously pivoted about. The side surface 50 and walking surface 42 of the buoyant blocks 32 of the adjacent dock sections 30 abut in this position. Due to the light-weight construction of the dock sections 30, the previously described movements from the locked position to the extended or spaced position to the pivoted position (and the reverse sequence) can be performed by virtually anyone with no special tools and moderate physical effort. The above-described operation of moving one dock section 30 pivotally about another through 90° to be stacked thereupon can be implemented repeatedly to effect a folding of the dock.

The bumper portions 38 and 40 serve to allow boats to be moored to the dock assemblage without contacting the link arms 28 and related components. As a result, the boat will not be scratched by these components due to its engagement with the bumpers 38 and 40.

Figure 10:
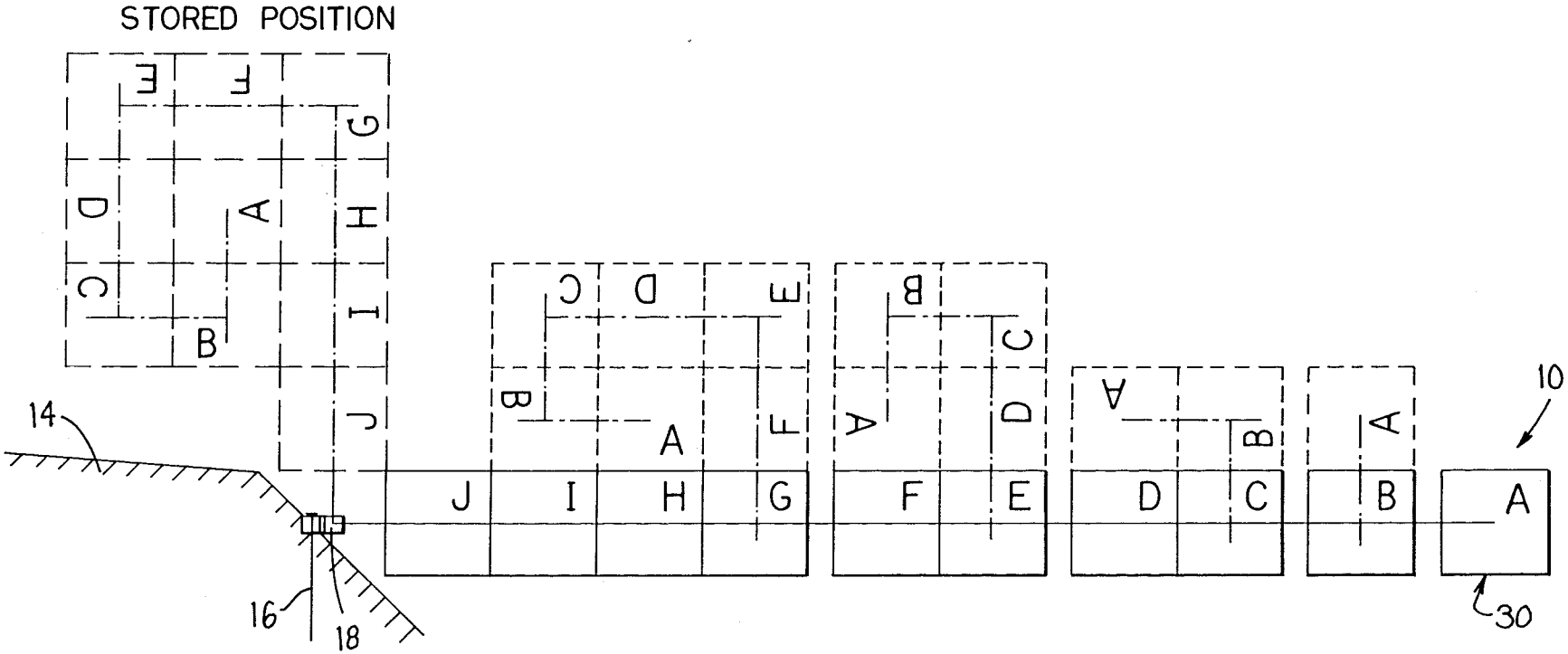
FIG. 10 is a diagram showing one procedure by which the dock can be folded.

FIG. 10 is a diagram showing one method of folding the inventive foldaway dock 10. This diagram depicts a dock 10 which has 10 dock sections 30. The dock sections are designated A through J, J being the closest to the shoreline 14 and A being furthest therefrom. The folding operation begins with dock section A which is extended away from and pivoted through 90° about dock section B and stacked thereupon to form a 2×1 structure. Next, section B is extended from and pivoted through 90° about section C and stacked thereupon which causes section A to be pivoted again through 90° but this time to stack upon section D, yielding a 2×2 structure. Section D is then extended from and pivoted through 90° about section E and stacked thereupon, bringing section A to stack upon section F, with sections B and C stacked upon sections A and D, respectively, to form a 3×2 structure. Dock section F is then extended from and pivoted through 90° about section G and stacked thereupon leaving dock section B stacked upon dock section I, and dock section A stacked upon dock section H, with sections C, D and E stacked upon sections B, A and F, respectively, to form a 3×3 structure. Thereafter, section J is pivoted through 90° about the anchor arm 18 by means of the pivotal mounting arms 22 shown in FIG. 8. The dock is thus fully retracted from the surface of the water 12 and is folded for storage on the shoreline 14 as shown in FIG. 2. Of course, other schemes for folding the sections exist for a 10-section foldaway dock, and even more folding configuration possibilities exist for docks which contain other than 10 sections.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A foldaway floating dock for use on a body of water, comprising:

a plurality of floatable dock sections; and a frame for interconnecting said plurality of dock sections, said frame including first means for slidably supporting each of said plurality of dock sections for movement away from and toward a mutually adjacent said dock section between a first position generally abutting said mutually adjacent dock section and a second position spaced from said mutually adjacent dock section, said frame further including second means for facilitating pivotal movement of each said dock section relative to a respective said mutually adjacent dock section and operable only when said dock section is in said second position to thereby effect a folding of said dock section upon said respective mutually adjacent dock section.

2. The foldaway floating dock according to claim 1, wherein each said dock section includes a buoyant block adapted to float directly in the water, and wherein each said dock section is pivotable through 90° relative to a respective said mutually adjacent dock section.

3. The foldaway floating dock according to claim 2, wherein each said dock section further includes at least one frame unit and fastening means for securing said at least one frame unit to the outer periphery of each said buoyant block.

4. The foldaway floating dock of claim 3, wherein said buoyant blocks are constructed from a buoyant foam material encased in a high-strength plastic shell.

5. The foldaway floating dock of claim 4, wherein said buoyant blocks are of substantially uniform shape.

6. The foldaway floating dock of claim 5, wherein said buoyant blocks are of substantially uniform size.

7. The foldaway floating dock according to claim 3, wherein said frame units are composed of elongated bands of material.

8. The foldaway floating dock according to claim 7, wherein each said buoyant block has upper and lower parts separated by means defining a groove, a substantial portion of each said band being disposed within said groove.

9. The foldaway floating dock according to claim 3, including anchor means for securing at least one said dock section to the land adjacent the body of water.

10. A foldaway floating dock, comprising:

a plurality of floating dock elements;

a plurality of frame units each secured to the outer periphery of a respective said floating dock element;

a plurality of link arms interconnecting said plurality of frame units, each said link arm having first means defining a fixed end fixedly attached to a first said frame unit;

second means for slidably and pivotally connecting said link arm to a second said frame unit to facilitate substantially linear sliding movement of said first frame unit between first and second positions respectively adjacent and substantially linearly spaced from said second frame unit and to facilitate pivotal movement of said first frame unit with respect to said second frame unit and about a pivot axis when said first frame unit is in said second position substantially spaced from said second frame unit; and third means for manually releasably locking said first and second frame units together to render said first and second frame units fixed with respect to one another only when said first frame unit is in said first position adjacent said second frame unit.

11. The foldaway floating dock according to claim 10, wherein said third means includes a releasable lock member for releasably fastening a free end of said link arm to said second frame unit when said first frame unit is in said first position and thereby preventing said substantially linear movement of said first frame unit between said first and second positions.

12. A pivotal frame for use with a foldaway floating dock, comprising:

a plurality of frame units each adapted to be secured to the outer periphery of a floating dock element;

a plurality of link arms interconnecting said plurality of frame units, each said link arm having first means defining a fixed end fixedly attached to a first said frame unit;

second means for slidably and pivotally connecting said link arm to a second frame unit to facilitate movement of said first frame unit away from and toward said second frame unit and about a pivot axis; and third means for locking said first and second frame units together when said units are directly adjacent, said third means including fourth means for releasably fastening a free end of said link arm to said second frame unit and thereby preventing said movement of said first frame unit toward and away from said second frame unit, said fourth means including a plate fixed to said second frame unit, and means for defining a first hole in said free end of said link arm and for defining a second hole in said plate, said free end of said link arm being slidable alongside said plate to align said first hole in said link arm with said second hole in said plate, said fourth means further including an elastic member fixed to said plate, and a fastening member extending from said elastic member, said elastic member yieldably urging said fastening member for insertion of said fastening member through said aligned first and second holes.

13. The foldaway floating dock according to claim 10, wherein said first frame unit is pivotable through 90° about said pivot axis.

14. The foldaway floating dock according to claim 13, wherein said second means includes a pair of hinge pins located at laterally spaced and opposite ends of each said frame unit.

15. The foldaway floating dock according to claim 10, wherein said second means includes means for defining an elongate slot in one of said link arm and said second frame unit, and a fixed hinge pin projecting from the other of said link arm and said second frame unit, said hinge pin being slidably received in said slot, said link arm being simultaneously slidable along and pivotable about said hinge pin so that said first frame unit is simultaneously supported for (1) said linear sliding movement along a first path of travel between said first and second positions, and (2) said pivotal movement along a second path of travel about said second frame unit, whereby said first frame unit is movable along a resultant composite path of travel defined by said first and second paths of travel.

* * * * *